United States Patent [19]

Neudahm

[11] Patent Number: 4,529,631

[45] Date of Patent: Jul. 16, 1985

[54] METHOD OF DEPOSITING A METALLIC AND/OR CERAMIC PROTECTIVE LAYER ON A SUBSTRATE

[75] Inventor: Walter Neudahm, Sandersdorf, Fed. Rep. of Germany

[73] Assignee: Castolin S.A., Saint-Sulpice, Switzerland

[21] Appl. No.: 563,389

[22] PCT Filed: Mar. 17, 1983

[86] PCT No.: PCT/CH83/00036

§ 371 Date: Nov. 16, 1983

§ 102(e) Date: Nov. 16, 1983

[87] PCT Pub. No.: WO83/03263

PCT Pub. Date: Sep. 29, 1983

[30] Foreign Application Priority Data

Mar. 19, 1982 [CH] Switzerland ..... 1713/82

[51] Int. Cl.[3] ..... B05D 1/08

[52] U.S. Cl. ..... 427/398.3; 427/398.1; 427/398.4; 427/398.5; 427/422; 427/423

[58] Field of Search ..... 427/34, 422, 423, 398.1, 427/398.2, 398.3, 398.4, 398.5

[56] References Cited

U.S. PATENT DOCUMENTS 4,191,791 3/1980 Lyons ..... 427/224
4,279,709 7/1981 McIntyre ..... 427/423 X
4,302,482 11/1981 Heck ..... 427/422 X
4,457,948 7/1984 Ruckle et al. ..... 427/423 X

FOREIGN PATENT DOCUMENTS 735032 12/1969 Belgium .
2224991 10/1974 France .
2347111 11/1977 France .
657300 9/1951 United Kingdom .

OTHER PUBLICATIONS

"Fachbeitrage", Steffens et al, Dusseldorf, BRD, Schweissen und Schneiden, 33(1981), Heft4; pp. 159–164.

*Primary Examiner*—Shrive P. Beck
*Attorney, Agent, or Firm*—Hopgood, Calimafde, Kalil, Blaustein & Judlowe

[57] ABSTRACT

The method comprises the steps of depositing, by thermal spraying of pulverulent materials, portions of layer in the shape of juxtaposed, adjacent strips having each a height corresponding substantially to the thickness of the layer to be formed. Each deposited portion of the layer is locally cooled so as to maintain the temperature differential between the substrate and the layer at a value lower than 100° C., preferably lower than 60° or 50° C. It is possible thereby to deposit layers up to 3 mm thick and to obtain very high density layers even from high melting point metals or from ceramic materials.

9 Claims, 2 Drawing Figures

METHOD OF DEPOSITING A METALLIC AND/OR CERAMIC PROTECTIVE LAYER ON A SUBSTRATE

The present invention refers to a method of depositing metallic and/or ceramic protective layer on a substrate by thermal projection of powdery materials.

In order to form hard protective layers of a relatively great thickness of metallic or ceramic materials, in general one deposits by thermal projection a number of superimposed elemental layers. The maximum thickness that can be achieved by such a method of a number of layers is however severely restricted and lies in practice between 0.3 and 0.5 mm. This is due in particular to the severe internal stresses which appear in such a protective layer and which can be reduced only partially by a suitable choice of the parameters of projection and whilst accepting an increased porosity of the layer. Furthermore, in particular when it is a question of ceramic materials deposited in a number of superimposed layers, an accumulation of heat occurs at the level of each elemental layer deposited, which leads to a high temperature difference between the substrate and the layer, this temperature difference increasing with each elemental layer and possibly reaching 150° C. This is manifested in general by the formation of cracks and breakdown of the adhesion between the various elemental layers.

The invention proposes to provide a method which enables the application of layers of relatively great thickness, that is to say, in practice up to 3 mm, from materials having a high melting point or ceramic materials, whilst enabling layers of high density to be achieved, that is to say, of very low porosity.

For this purpose the method in accordance with the invention is characterized in that portions of a layer are deposited in succession in the form of adjacent juxtaposed strips, each having a height which corresponds substantially with the thickness of the layer which is to be formed, the substrate being kept during the process of deposition at a temperature less than 300° C. and the difference in temperature between the substrate and a point on a portion of deposited layer, measured at the latest before the depositing of an adjacent portion of layer in the vicinity of the said point, being kept below 100° C. Preferably local cooling is carried out at the level of each portion of layer deposited so that the temperature of the substrate does not exceed 200° C. or even 100° C. and that the said difference in temperature between the substrate and a point on a portion of deposited layer does not exceed 50° or 60° C. The cooling is preferably carried out by means of a device which includes outlet nozzles for cooling fluid, which are pinpoint, annular, linear or fan-shaped, or else distributed over an area, the cooling fluids being preferably chosen from water, liquid carbon dioxide, nitrogen, and compressed air, and they may be applied in a combined manner.

Figure 1:
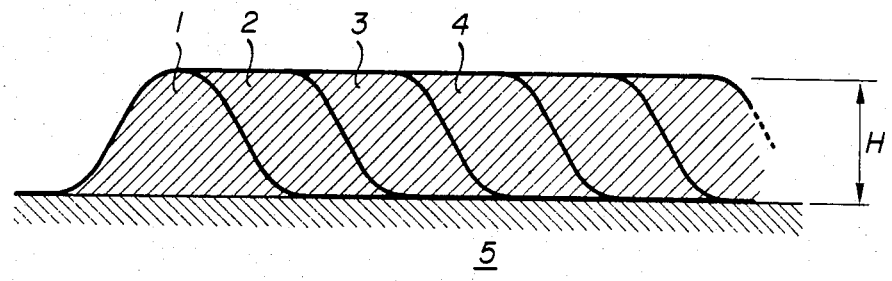
Figure 2:
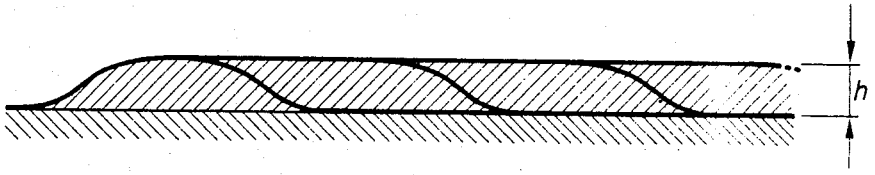

The invention will be better understood in the light of the examples given below and of the description illustrated by the attached drawing in which:

FIG. 1 and 2 represent diagrammatically the structure of a protective layer achieved by the method in accordance with the invention.

The portions of layer in the form of strips 1, 2, 3, 4, etc. represented in FIG. 1 are deposited adjacently, side by side upon a substrate 5. Each portion of layer so deposited exhibits substantially the total height H of the layer which is to be formed. This is obtained by a suitable choice of the parameters of projection and of the relative motion between the projection apparatus and the substrate. For the formation of a layer 0.1 to 3 mm thick upon a cylindrical piece one chooses, for example, a constant circumferential velocity of the piece of the order of 5 to 60 m/min and a velocity of translation in the axial direction between $10^{-4}$ and 1 m/min. In the case of the depositing of such a layer upon a plane surface a relative motion between the piece and the projection apparatus is chosen which is effected discontinuously in steps the length of which lies between 0.1 and 20 mm, and a relative motion in the direction perpendicular to the foregoing at a velocity similar to that employed in the axial direction of the cylindrical piece mentioned above. The quantity of powder supplied to the projection device lies between 0.2 and 3 kg/h. For a thickness of layer of 0.25 to 2.5 mm the corresponding values are in the order of the values given above: 20 to 40 m/min, $5.10^{-4}$ to 0.5 m/min and 0.5 to 15 mm, the quantity of powder projected ranging from 0.5 to 2 kg/h.

In particular, in the case of layers which exceed 0.5 mm in thickness, the portion of layer applied is cooled locally so as to keep the difference in temperature between the base piece and the layer to a value less than 60° and preferably 50° C.

As shown in FIG. 1, the several portions of layer applied overlap only partially, which enables an accumulation of heat to be avoided in the portions of layer deposited in succession. On the other hand, the internal stresses appearing in the layer are no longer directed in parallel with the surface of the base piece but are inclined with respect to this surface so that the danger of a breakdown of the adhesion of the layer is practically eliminated.

FIG. 2 shows the example of a layer of less thickness h, in which the several portions of layer are relatively wider but overlap only partially in a similar manner to the case illustrated in FIG. 1.

The following examples describe the realization of protective layers having a thickness and a quality, especially as far as the absence of cracks and pores is concerned, which hitherto were considered as impossible of achievement with the materials concerned.

EXAMPLE 1

Onto a shaft of ST 37 steel of a diameter of 40 mm a protective layer 1.5 mm thick is applied by employing a powder which includes by weight 87% $Al_2O_3$ and 13% $TiO_2$. A flame projection torch of "Castodyn 2000" type (trademark of the Castolin S.A. company) was located at a distance of 90 mm from the surface of the shaft in order to carry out the projection. The quantity of powder supplied was adjusted to 1.0 kg/h and a rotary support for the shaft was driven as follows: circumferential velocity of the shaft 30 m/min; feed in the axial direction 0.025 m/min.

A cooling device was arranoed round the shaft at the point of projection, this device including an annular arrangement of individual nozzles having each an opening of 1 mm in diameter and being fed with liquid carbon dioxide. The distance between the axis of the flame and the median plane of the annular nozzles was 20 mm so that the cooled zone was an annular zone 2 mm wide. The feed of cooling liquid was regulated to about 4 liters/min (l/min) and adjusted so that the temperature of the shaft was less than 100° C. and the difference in temperature between one portion of deposited layer and the surface of the shaft, measured immediately after shutting off the projection and cooling device before the next passage of the point being considered through the projection position, was less than 20° C.

EXAMPLE 2

A slide bush of ST 37 steel having an outer diameter of 100 mm and an inner diameter of 50 mm was equipped on the outside with a layer of molybdenum 1 mm thick. The torch employed was of the same type as in Example 1 and the feed of powder was regulated to 1.2 kg/h. The distance between the nozzle of the torch and the surface of the bush was 100 mm and the driving of the rotary supporting device, similar to that of Example 1, was chosen as follows: circumferential velocity 30+5 m/min; feed in the axial direction 0.05 m/min.

In order to effect the cooling, a first device having nozzles distributed over an area of 20 mm×20 mm was mounted in a position diametrically opposite to the axis of the flame of the torch at a distance of 12 cm from the surface of the bush and was fed with liquid carbon dioxide at a rate of 3.5 l/min. A second device having nozzles distributed over an area of 5 mm×10 mm was arranged at a distance of 30 mm from the first device, this distance being measured in the direction of rotation of the bush along its surface, and was fed with nitrogen at a flow of 7 l/min. In this way the temperature of the piece reached 150° C. at most and the difference in temperature between the piece and the protective layer, measured as in Example 1, was less than 50° C.

After polishing, the final thickness of the layer was 0.9 mm and its surface exhibited no visible pores and no visible cracks. The working life was 50% longer than that of bushes provided with a number of superimposed protective layers of the same total thickness.

EXAMPLE 3

The bearing surface of a shaft of grey cast iron 150 mm in diameter was covered over with a layer of bronze (10% Al, 90% Cu) 2 mm thick over a length of 100 mm. The equipment employed included a "Rototec 80" projection torch (trademark of the Castolin S.A. company) to which the feed of powder was regulated to 1.5 kg/h and the distance between the projection nozzle and the surface of the shaft was 15 mm. A rotary supporting device was employed as in Examples 1 and 2 so as to impart to the shaft a circumferential velocity of 45 m/min and a feed in the axial direction of 0.02 m/min.

A series of cooling nozzles, each of diameter 2 mm, were arranged at a distance of 15 mm from the surface of the shaft along a semicircle in the form of a fan, these nozzles being fed with compressed air at a pressure of 6 atmospheres. The temperature of the surface of the shaft was thus kept to a value less than 250° C., the maximum difference in temperature between the layer and the substrate, measured as in Examples 1 and 2, having been 30° C.

With respect to the usual method of coating, the cost of the realization of the present rolling surface was distinctly less and the working life of the part was substantially increased.

EXAMPLE 4

Plungers for a piston pump, intended for being employed in strongly corrosive media were during manufacture in series, equipped over their sealing surface with a protective layer composed of 97% $Al_2O_3$+3% $TiO_2$.

The plungers were produced from a nickel-chrome alloy of the following composition: 20% Cr, 4% Fe, 0.5% Si, remainder Ni; their length was 850 mm and their diameter 40 mm. The sealing surface extended over a length of 500 mm and was coated with a protective layer of 0.8 mm. The depositing by projection and the polishing of the layer were effected in one single working phase. For this purpose a projection torch of the type of that as Example 1 was mounted on the feed device of a rotary supporting device and a polishing device was arranged at a distance of 20 mm from the axis of the flame. The circumferential velocity of the plunger was 60 m/min, the feed was 0.2 m/min and the polishing device was driven at 1200 r.p.m. The feed of powder to the projection torch was 0.7 kg/h and the projection distance was 80 mm.

A cooling nozzle fed with liquid carbon dioxide at the rate of 6 l/min was arranged diammetrically opposite the axis of the flame and had an opening of 0.5 mm×5 mm. On the other hand, an annular arrangement of nozzles of 1 mm in diameter was arranged at a distance of 100 mm from the axis of the flame between it and the polishing device, round the part to be treated. This latter cooling device was fed with water at a rate of 4 l/min and enabled the temperature of the deposited layer of 100° C. before the cooling with water, to be brought down to 50° C.

The plungers so realized exhibited a very good working life whilst the length of time of manufacture of the protective layer was reduced by half with respect to the usual method.

I claim:

1. A method of depositing a metallic and/or ceramic protective layer on a substrate by thermal projection of powdery materials, characterized in that portions of a layer are deposited in succession in the form of adjacent juxtaposed strips, each having a height which corresponds substantially with the thickness of the layer which is to be formed, the substrate being kept during the process of deposition at a temperature less than 300° C. and the diiference in temperature between the substrate and a point on a portion of deposited layer, measured at the latest before the depositing of an adjacent portion of layer in the vicinity of the said point, being kept below 100° C.

2. A method as in claim 1, characterized in that each portion of layer deposited is cooled locally.

3. A method as in claim 1, characterized in that the temperature is controlled by cooling such that the temperature of the substrate does not exceed 200° C. and the said difference in temperature between the substrate and a point on a portion of deposited layer does not exceed 60° C.

4. A method as in claim 1, characterized in that the temperature is controlled by cooling such that the temperature of the substrate does not exceed 100° C. and the said difference in temperature between the substrate and a point on a portion of deposited layer does not exceed 50° C.

5. A method as in claims 2, 3 or 4, characterized in that the temperature is controlled by cooling by means of at least one device including outlet nozzles for cooling fluid, directed in a fan.

6. A method as in claims 2, 3 or 4, characterized in that the temperature is controlled by cooling by means of at least one device including outlet nozzles for cooling fluid, arranged in an annular or linear manner.

7. A method as in claims 2, 3 or 4, characterized in that the temperature is controlled by cooling by means of at least one device including outlet nozzles for cooling fluid, distributed over an area.

8. A method as in claims 2, 3 or 4, characterized in that the temperature is controlled by employing a cooling fluid selected from the group consisting of liquid carbon dioxide, water, nitrogen and compressed air.

9. A method as in claims 2, 3 or 4, characterized in that the temperature is controlled by employing a combination of cooling devices which employ different cooling fluids selected from the group consisting of water, liquid carbon dioxide, nitrogen and compressed air.

* * * * *